US010736189B2

(12) United States Patent
Chen

(10) Patent No.: US 10,736,189 B2
(45) Date of Patent: Aug. 4, 2020

(54) MODULARIZED LIGHT SYSTEM, CONTROL MODULE THEREOF AND POWER MODULE THEREOF

(71) Applicant: Vaxcel International Co., Ltd., Carol Stream, IL (US)

(72) Inventor: Chia-Teh Chen, Taipei (TW)

(73) Assignee: VAXCEL INTERNATIONAL CO., LTD., Carol Stream, IL (US)

( * ) Notice: Subject to any disclaimer, the term of this patent is extended or adjusted under 35 U.S.C. 154(b) by 0 days.

(21) Appl. No.: 16/028,475

(22) Filed: Jul. 6, 2018

(65) Prior Publication Data

US 2018/0317293 A1 Nov. 1, 2018

Related U.S. Application Data

(63) Continuation of application No. 14/535,757, filed on Nov. 7, 2014, now Pat. No. 10,045,410.

(51) Int. Cl.

| | |
|---|---|
| ***H05B 45/10*** | (2020.01) |
| ***F21V 23/02*** | (2006.01) |
| ***F21V 23/00*** | (2015.01) |
| ***F21K 9/60*** | (2016.01) |
| ***H05B 47/10*** | (2020.01) |
| *F21Y 115/10* | (2016.01) |

(52) U.S. Cl.

CPC ..... *H05B 45/10* (2020.01); *F21K 9/60* (2016.08); *F21V 23/003* (2013.01); *F21V 23/008* (2013.01); *F21V 23/02* (2013.01); *H05B 47/10* (2020.01); *F21V 23/001* (2013.01); *F21Y 2115/10* (2016.08)

(58) Field of Classification Search

CPC .... H05B 37/02; H05B 33/08; H05B 33/0815; H05B 33/0842; H05B 33/0845; H05B 33/0854; F21K 9/60; F21V 23/003; F21V 23/008; F21V 23/02; F21V 23/001; F21Y 2115/10

See application file for complete search history.

(56) References Cited

U.S. PATENT DOCUMENTS

| | | | |
|---|---|---|---|
| 7,384,166 | B2 | 6/2008 | Tress |
| 7,604,369 | B2 | 10/2009 | Tress |
| 8,545,045 | B2 | 10/2013 | Tress |

(Continued)

*Primary Examiner* — Jimmy T Vu

(74) *Attorney, Agent, or Firm* — Li & Cai Intellectual Property (USA) Office

(57) ABSTRACT

A modularized LED lighting system comprising combinations of a control module, a power module and at least one LED light module is provided, wherein two adjacent modules are detachably connected with a connection unit. A novel design uses a single power module and a control module for transmitting a power or a power and a control signal to one or a plurality of LED light module with one or a plurality of connection units detachably and remotely connecting the LED light modules. Alternatively the control module can be integrated with at least the power module or can be integrated with at least the LED light module to become at least a two-module modularized lighting system. The system installation is simplified and the designs are coordinated with advantages such as fast assembly, saving assemble time, saving effort, a neat appearance, no wire entanglement, and flexibility of extending lighting range.

23 Claims, 16 Drawing Sheets

(56) References Cited

U.S. PATENT DOCUMENTS

| | | | | |
|---|---|---|---|---|
| 9,069,519 | B1 * | 6/2015 | Hall | F21K 9/90 |
| 2005/0007031 | A1 | 1/2005 | Hyder | |
| 2007/0217209 | A1 * | 9/2007 | Wong | H05B 33/0842 362/418 |
| 2009/0021955 | A1 | 1/2009 | Kuang et al. | |
| 2010/0008090 | A1 | 1/2010 | Qing et al. | |
| 2010/0109530 | A1 | 5/2010 | Ecke et al. | |
| 2010/0176744 | A1 | 7/2010 | Lee et al. | |
| 2010/0237798 | A1 | 9/2010 | Wolf et al. | |
| 2012/0002417 | A1 | 1/2012 | Li | |
| 2013/0016500 | A1 | 1/2013 | Tress | |
| 2013/0182422 | A1 | 7/2013 | Guilmette | |
| 2013/0211608 | A1 | 9/2013 | Farrel et al. | |
| 2014/0001962 | A1 | 1/2014 | Harris | |
| 2014/0300282 | A1 | 10/2014 | Grave et al. | |
| 2014/0328054 | A1 | 11/2014 | Anderson et al. | |
| 2016/0029460 | A1 | 1/2016 | Bean et al. | |
| 2017/0198889 | A1 | 7/2017 | Li | |

* cited by examiner

MODULARIZED LIGHT SYSTEM, CONTROL MODULE THEREOF AND POWER MODULE THEREOF

This Application is a continuation application of prior U.S. application Ser. No. 14/535,757 filed on Nov. 7, 2014, the entire contents of which are incorporated herein by reference.

BACKGROUND

1. Technical Field

The present disclosure relates to a light system; in particular, to a modularized light system, a control module thereof and a power module thereof.

2. Description of Related Art

General residential interior design uses hanging cabinet facilities for home storage items, and the space below the cabinets usually designed to place a workbench. Personal book cabinet and the reading desktop below the bookcase, or the wide cabinets in the kitchen and the cooking bench below the cabinets need under cabinet lighting with proper size fitting in with the corresponding cabinet. In other words, the lighting below the cabinet is an important part of indoor lighting. As the cost of the LED (light-emitting diode) decreases, along with the development of lighting technology and the advantage of saving energy for the LED, the LED has gradually been the main light source of the cabinet lighting for residential design.

Most of the commercially available LED cabinet lights are long cartridge type, such as the built-in cabinet light shown in FIG. 1A and FIG. 1B. That is, the driving power, control circuit and the light unit are integrated in the case of the long cartridge. The model shown in FIG. 1A only has the alternative current (AC) power input port, and the model shown in FIG. 1A can be used individually, thus it cannot be serially connected for extending the lighting range. The model shown in FIG. 1B has both of the power input port and the power output port, thus it has expandability, in which one or more connection units can be utilized to connect with multiple light devices in series to extend the lighting range. This type of the built-in cabinet light occupies large space due to the built-in driving power and the control circuit, thus the appearance of this type of the built-in cabinet light looks bulky, thereby the transportation costs is increased and it does not meet the stylish slim design. Further, the built-in cabinet light is a design of parallel circuit when the built-in cabinet light is serially connected to be extended, in which the AC power with high voltage transmits from the output port of the first light module to the input port of the second light module through the connection unit, wherein leakage of electricity is possible during transmitting the high voltage AC power between the light modules, and the potential risk of electric shock could not be avoided when the user manipulates the light device. Further, each of the connected light devices has built-in driving circuit and control circuit in itself, thus it expenses multiple manufacturing costs and it is uneconomical. A good example, U.S. Pat. No. 8,545,045 discloses a modular LED lighting system that may reflect only a portion of the above technology with a much limited capacity comprising only an expandability of power transmission and on/off control. It does not have a capability of performing a dimming synchronization, a color tuning synchronization or a control flexibility in terms of positioning the control module anywhere convenient to a user. Additionally the use of H shaped connector totally precludes a possibility to layout each of the plurality of light modules according to considerations of optimizing illumination effect in a needed area with an excellent budget control and achieving an aesthetics of space management. Another prior art is US Pub. No. 2016/0029460 which discloses a modular lighting system in a different field of application for providing illumination control in a trailer connected to a truck. Although a control signal is also used in the system. It is not designed for the same purpose and function of the present invention. It is limited to perform power on/off only. The system uses a complicated combination of a master controller and at least a dedicated controller to one way control a state of a plurality of light modules in at least two illumination spaces. The master control unit has to be positioned up front and it lacks of flexibility and convenience required in a residential application. In order to improve multiple disadvantages of the commercially available products, the present invention discloses a novel design which utilizes a much more user friendly module concept working in conjunction with a human-machine interface for transmitting low voltage DC power and control signals to achieve a flexibility of performing two way control and achieve an aesthetics of space management. The plurality of light modules connected in series through one or more connection units which transmits power or power & control signals enable a capacity to perform various lighting jobs. The fact that the control module is not necessarily connected right after the power module but anywhere in the middle of light modules or even at the end through a connection unit is an unique advantage of the present invention. Aesthetics, security, expandability, control flexibility and economic low cost all can be achieved such that a much more user friendly cabinet lighting solution is obtained.

SUMMARY OF THE INVENTION

The object of the present disclosure is to provide a modularized light system and a control module and a power module thereof utilizes modularized connection manner to provide a plurality of combinations of light system, in order to meet the requirement of diverse lighting needs.

According to an embodiment of the present disclosure, the modularized light system comprises at least one light module, a control module and a power module, wherein the internal and external wiring of the electric power source is integrated into the one power module. The wiring of the control circuit and the electric power transmission is integrated into the one control module. The wiring of the electric power transmission and the light source is integrated into the light module. According to an embodiment of the present disclosure, a complete light system is established by serially connecting one power module, one control module and at least one light module while utilizing detachable connection units. Thus, one power module delivers the electric power to one control module and one or more light modules, and one control module is used to control turning-on or turning-off the one or more light modules. Wherein the control module can be connected anywhere in the system after the power module.

In order to achieve the aforementioned objects, according to an embodiment of the present disclosure, a modularized light system is provided. The modularized light system comprises a first light module, a control module, a first connection unit and a power module. The first light module has a first input portion and a first output portion. The first input portion has a first power terminal and a first control terminal. The first output portion has a second power terminal and a second control terminal, wherein the first light module receives a control signal through the first control terminal of the first input portion and receives a direct current (DC) power through the first power terminal of the first input portion, and the first light module emits light according to the control signal. The control module comprises a human machine interface, an output portion and an input portion. The output portion has a power output terminal and an output control terminal. Further, the input portion can be designed to have the same connection as that of input portion of a light module. The human machine interface of the control module generates the control signal and outputs the control signal through the output control terminal and the control terminal of input portion. The first connection unit has a pair of first power wires and a first control wire. The output portion of the control module detachably connects to the first input portion of the first light module through the first connection unit, wherein the pair of power wires is used for detachably connecting to the first power terminal of the first input portion and the power output terminal of the output portion. The first control wire is for detachably connecting to the first control terminal of the first input portion and the output control terminal of the output portion. The first power terminal of the first input portion of the first light module receives the DC power from the control module through the pair of first power wires of the first connection unit. The first control terminal of the first input portion of the first light module receives the control signal from the control module through the first control wire of the first connection unit. The power module has a power output portion, and the power module detachably connects to the input portion of the control module, for providing the DC power to the control module.

In order to achieve the aforementioned objects, according to an embodiment of the present disclosure, a control module is provided. The control module is used for detachably connecting to a first light module and a power module of a modularized light system. Further, the control module can also be used for detachably connecting between two light modules or at the end of a light module. The first light module has a first input portion and a first output portion. The first input portion has a first power terminal and a first control terminal. The first output portion has a second power terminal and a second control terminal. The control module comprises a human machine interface, an output portion and an input portion. The human machine interface generates a control signal. The output portion electrically connects to the human machine interface. The output portion has a power output portion and an output control terminal. The power output terminal outputs a DC power, and the output control terminal outputting the control signal. The input portion electrically connects to the human machine interface and the output portion. The input portion detachably connects to the power module, for receiving the electrical power from the power module. The output portion of the control module detachably connects to the first input portion of the first light module through the first connection unit. A pair of first power wires of the first connection unit is used for detachably connecting the first power terminal of the first input portion and the power output portion of the output portion. A first control wire of the first connection unit is used for detachably connecting the first control terminal of the first input portion and the output control terminal of the output portion. The first power terminal of the first input portion of the first light module receives the DC power from the control module through the pair of first wires of the first connection unit. The first control terminal of the first input portion of the first light module receives the control signal from the control module through the first control wire of the first connection unit.

In order to achieve the aforementioned objects, according to an embodiment of the present disclosure, a power module is provided. The power module is used for a modularized light system. The modularized light system has a first light module and a control module. The power module detachably connects to the control module of the modularized light system. The control module has an output portion and an input portion. The first light module has a first input portion and a first output portion. The first input portion has a first power terminal. The first output portion has a second power terminal. The power module comprises a power output portion. The power output portion detachably connects to the input portion of the control module, for providing a DC power to the control module. The output portion of the control module detachably connects to the first input portion of the first light module through a first connection unit. A pair of first power wires of the first connection unit is used for detachably connecting to the first power terminal of the first input portion and a power output terminal of the output portion, wherein the first power terminal of the first input portion of the first light module receives the DC power from the control module through the pair of first power wires of the first connection unit.

In summary, a modularized light system and a control module and a power module thereof are offered. Modularized connection manner is utilized to achieve various combinations of lighting, in order to meet the requirement of diverse lighting needs. It is worth mentioning that the design of this invention unlike the concept of the well-known junction box which only providing wire connections. The characteristics of this invention are listed in the following: (1) integrating the electric power transmission wires, the control signal wires and the light source into one module box for being the light module; (2) integrating the electric power transmission wires and the control circuit into one module box for being the control module; (3) integrating the AC/DC power wiring and the power driving circuit into one module box for being the power module. The disclosed embodiments utilize the concept of modularized design, in order to use the space efficiently, reduce the number and the length of the wires, and avoid wire entanglement. This concept of modularized design could provide high flexibility to the system design and also offer convenience of the assembling for enhancing the usability of the system.

In order to further the understanding regarding the present disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1A:
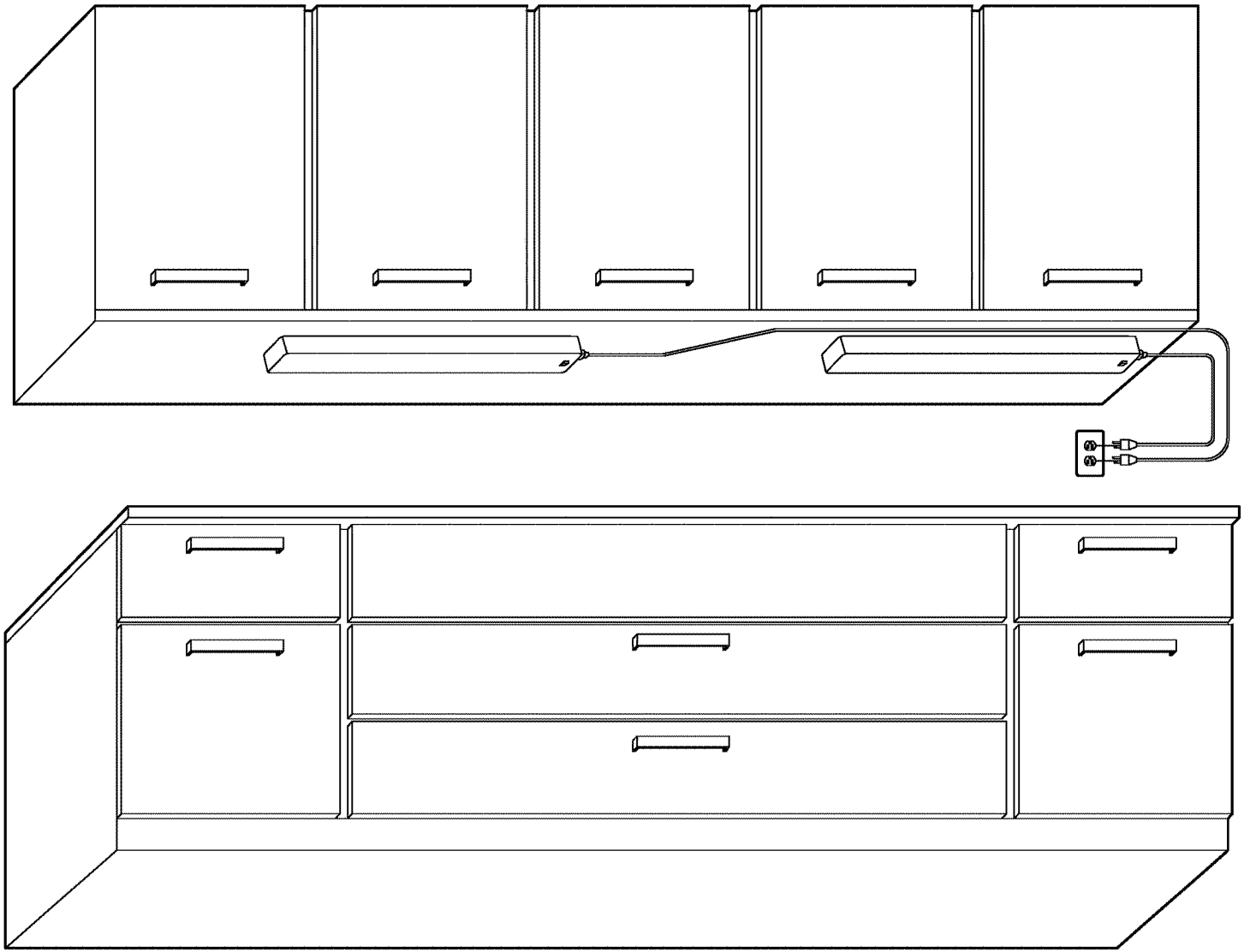
FIG.1A(PRIOR ART)
FIG. 1A shows a perspective diagram of a conventional cabinet lighting system.
Figure 1B:
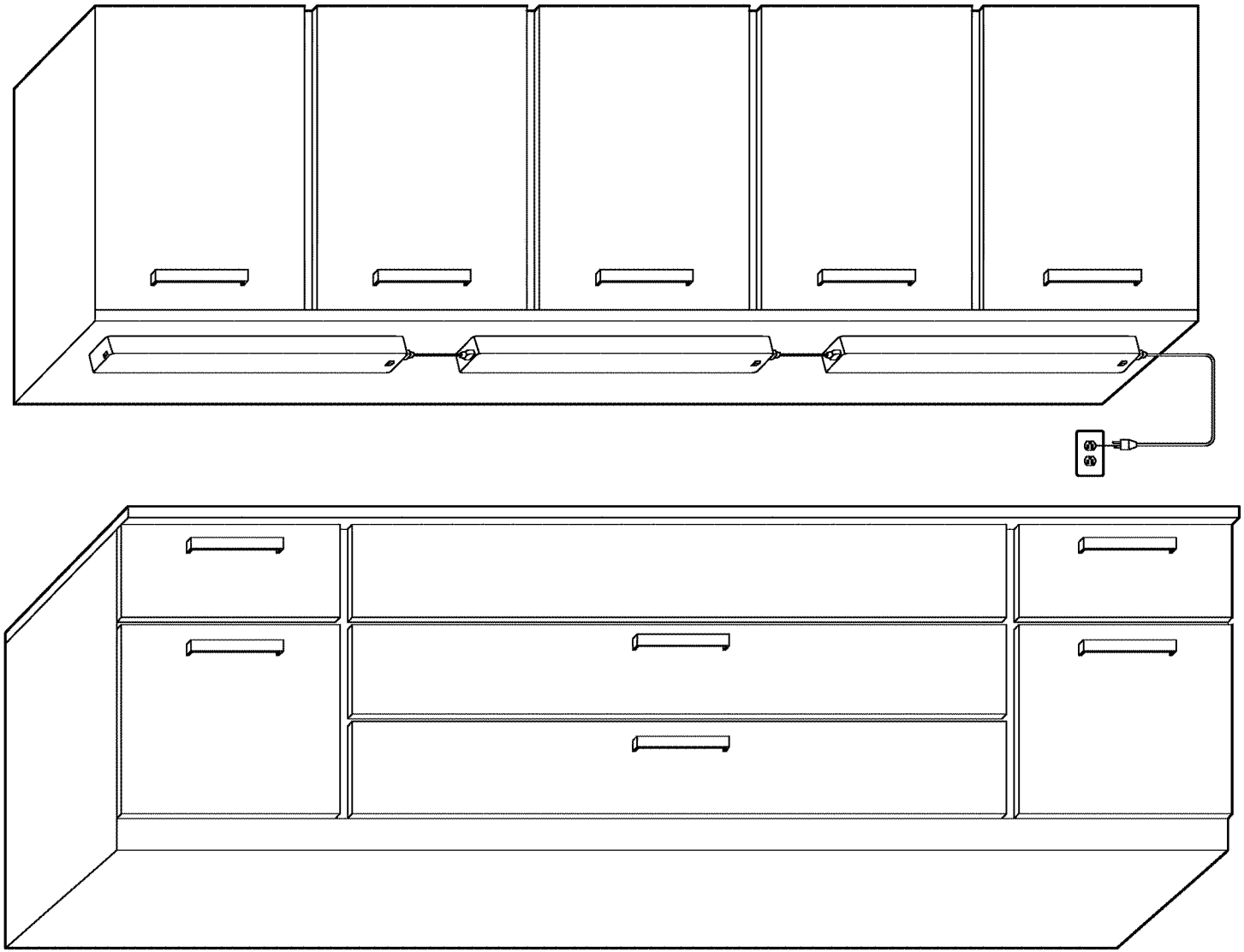
FIG.1B(PRIOR ART)
FIG. 1B shows a perspective diagram of a conventional cabinet lighting system.
Figure 2A:
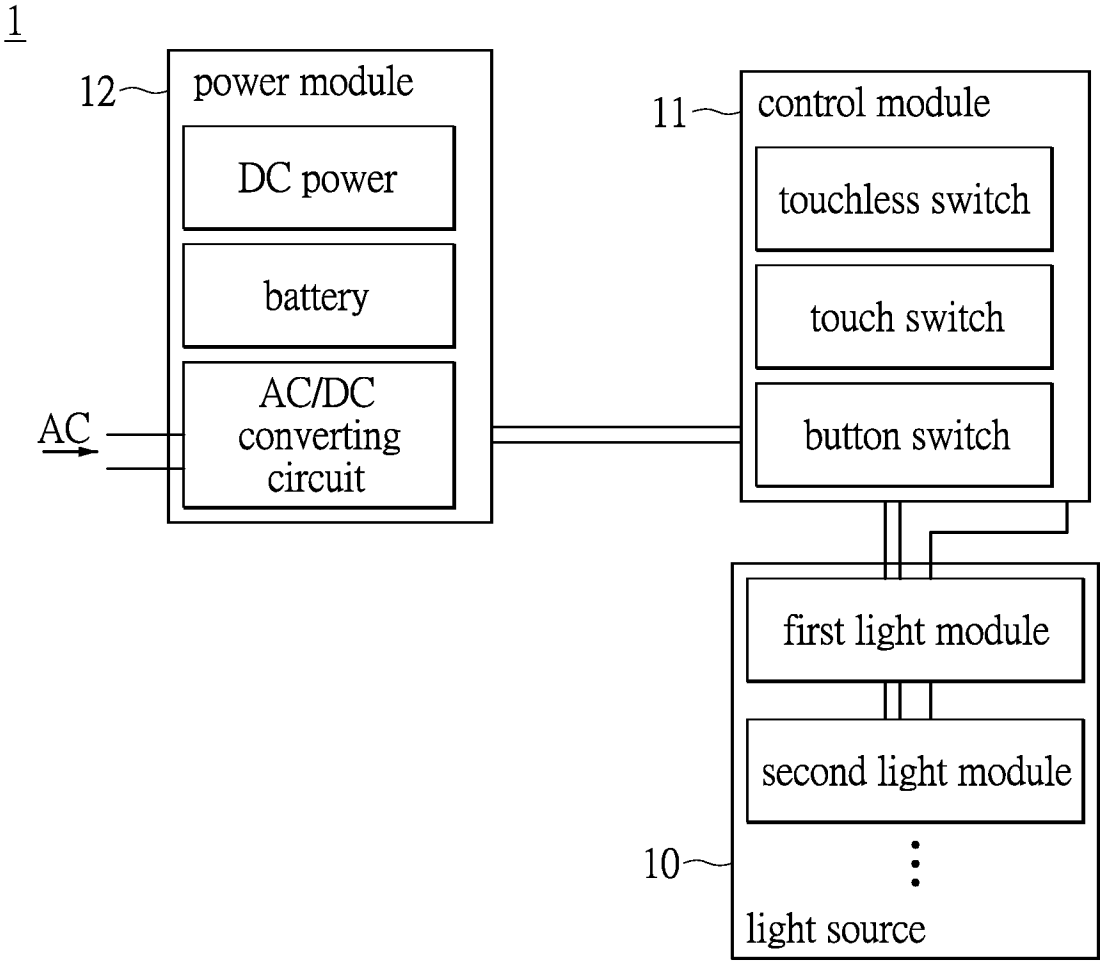
FIG. 2A shows architecture of a modularized light system according to an embodiment of the present disclosure.
Figure 2B:
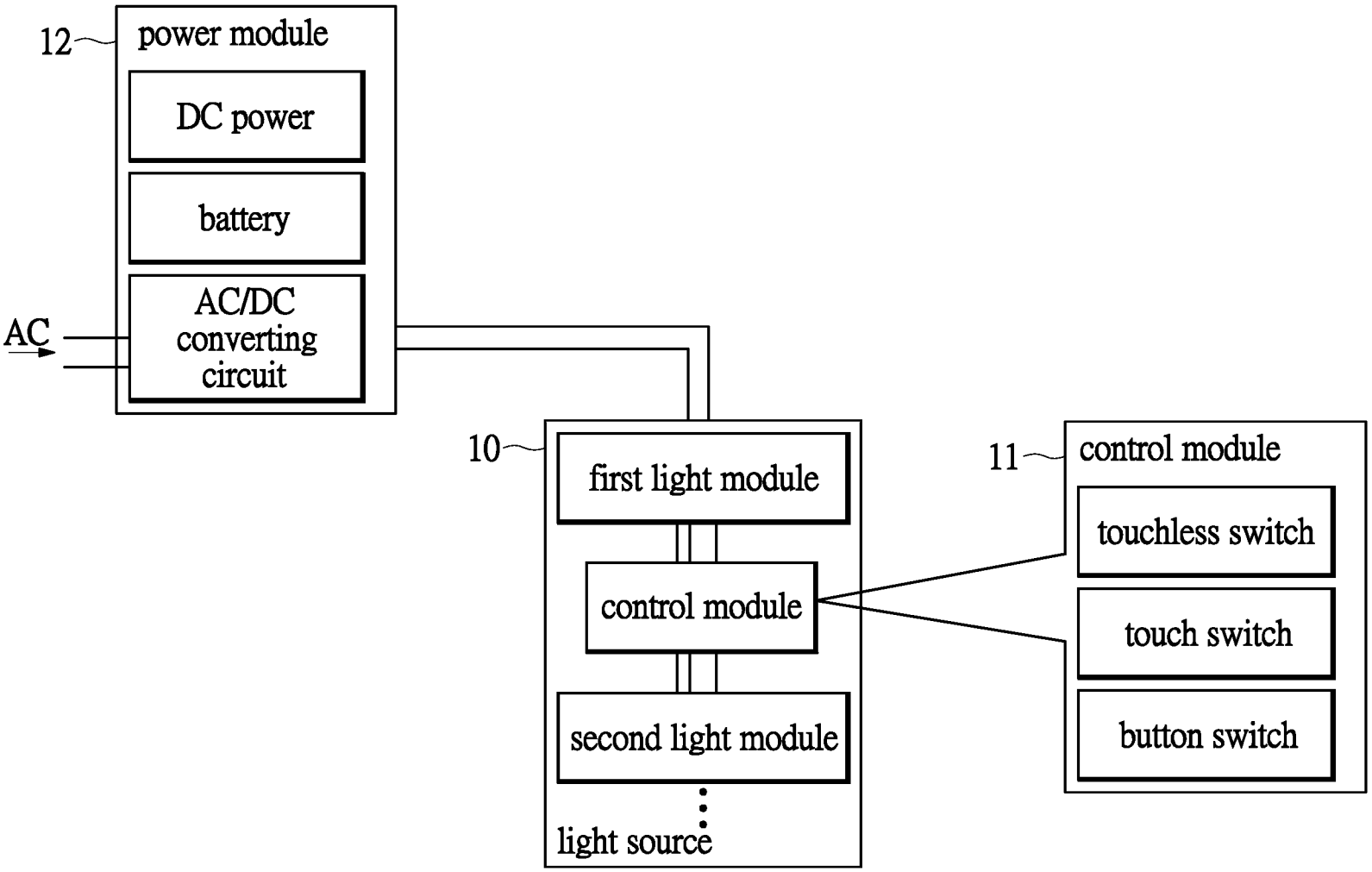
FIG. 2B shows another architecture of a modularized light system according to an embodiment of the present disclosure.

An Embodiment of a Modularized Light System, a Control Module and a Power Module Thereof Please refer to FIG. 2A and FIG. 2B showing architectures of a modularized light system according to an embodiment of the present disclosure. The modularized light system 1 substantially includes three main modules which are a light source 10, a control module 11 and a power module 12. The power module 12 could receive an alternative current (AC) power (such as the electricity mains). The power module 12 coupled to an AC power source could utilizes internal AC/DC conversion circuit to convert the AC power to a DC power, and provides the DC power to the control module 11. However, in another embodiment, the power module 12 may not connect to the AC power source but utilize an internal DC power source or a battery to provide a DC power. When the control module 11 receives the power from the power module 12, the control module 11 could provide a control signal to the light source 10 according to the user's manipulation, for controlling the light status of the light source 10. Connection wires are utilized to establish detachable connections between each module. The user or the person of installing the light systems could conveniently achieve the installation for the light systems according to the environment, wherein the length of the connection wires for connecting each of the modules may be designed in a variety of length, for providing a flexible installation scheme corresponding to the distances between the modules and the relative positions.

The control module 11 may comprises a variety of human machine interfaces such a touch control switch, a button switch or a touchless switch (which may be an infrared sensor switch), for the user to manipulate the light system. Due to the modularized design, the control module 11 may be set up at a position anywhere within the system and after the power module allowing the user to manipulate conveniently, and also the position of the light source 10 is not influenced.

The light source 10 may comprises at least a light module or a plurality of light modules independent to each other, and the light modules could be detachably connected or removable. As shown in FIG. 2A for example, the light source 10 comprises a first light module, a second light module . . . etc. The present disclosure does not restrict the number of the light modules. Accordingly, the modularized light system 1 could provide conveniently manipulation for the user, and a variety of light needs could be taken into account. Details of the embodiment can be referred to the following descriptions.

Figure 3:
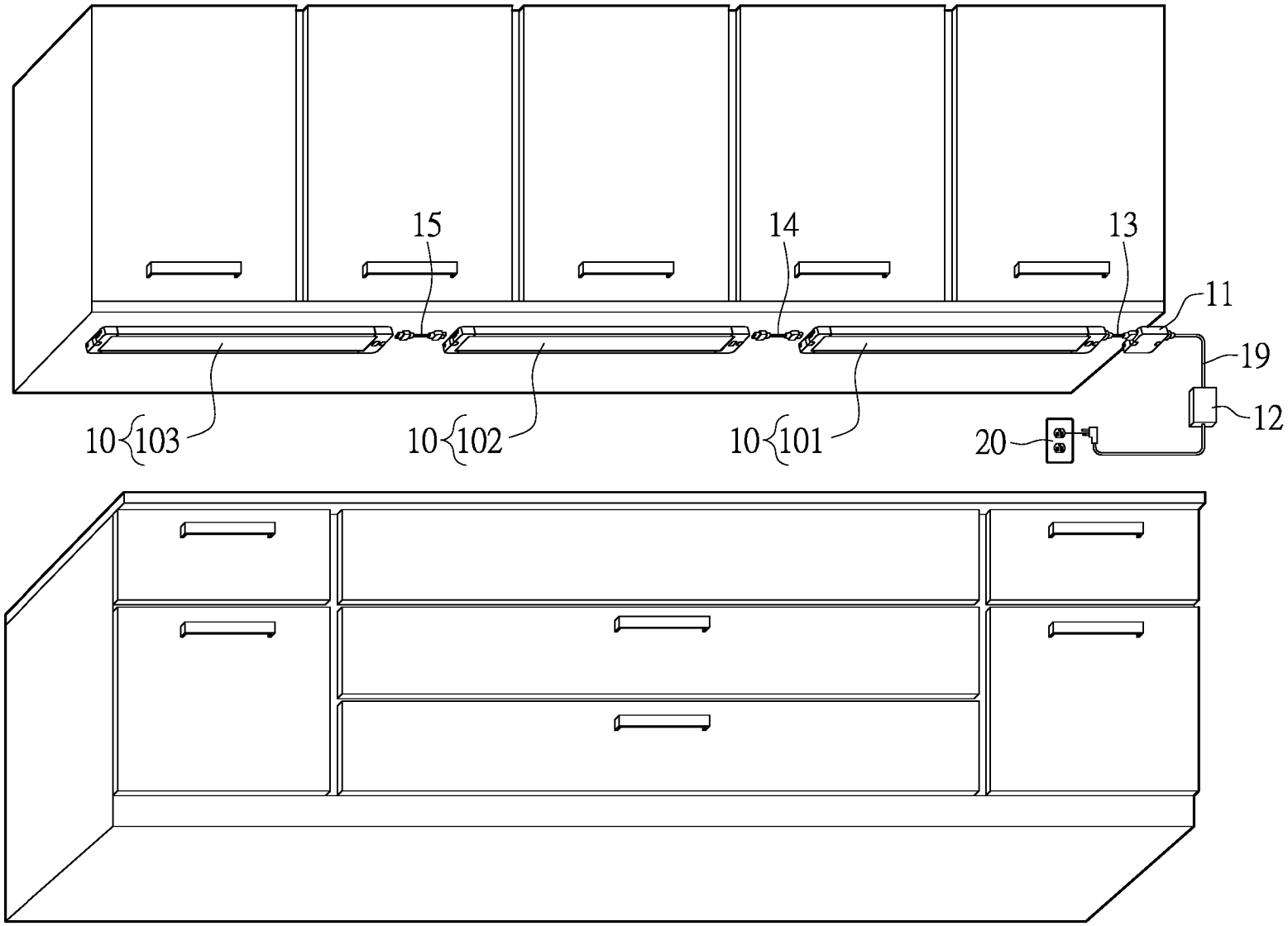
FIG. 3 shows a schematic diagram of a modularized light system according to an embodiment of the present disclosure.

Please refer to FIG. 2A in conjunction with FIG. 3, FIG. 3 shows a schematic diagram of a modularized light system according to an embodiment of the present disclosure. The modularized light system comprises a first light module 101, a second light module 102, a third light module 103, a control module 11, a first connection unit 13, a second connection unit 14, a third connection unit 15 and a power module 12. As shown in FIG. 3, the light source 10 includes three light modules, which are the first light module 101, the second light module 102 and the third light module 103 for ease of explanation, but the number of the light modules included in the modularized light system is not restricted thereto. Additionally, in this embodiment, the power module connects to an AC outlet 20, however when the power module 12 includes a direct current power source (such as a battery) the power module 12 may not need to connect the AC outlet 20.

Figure 2C:
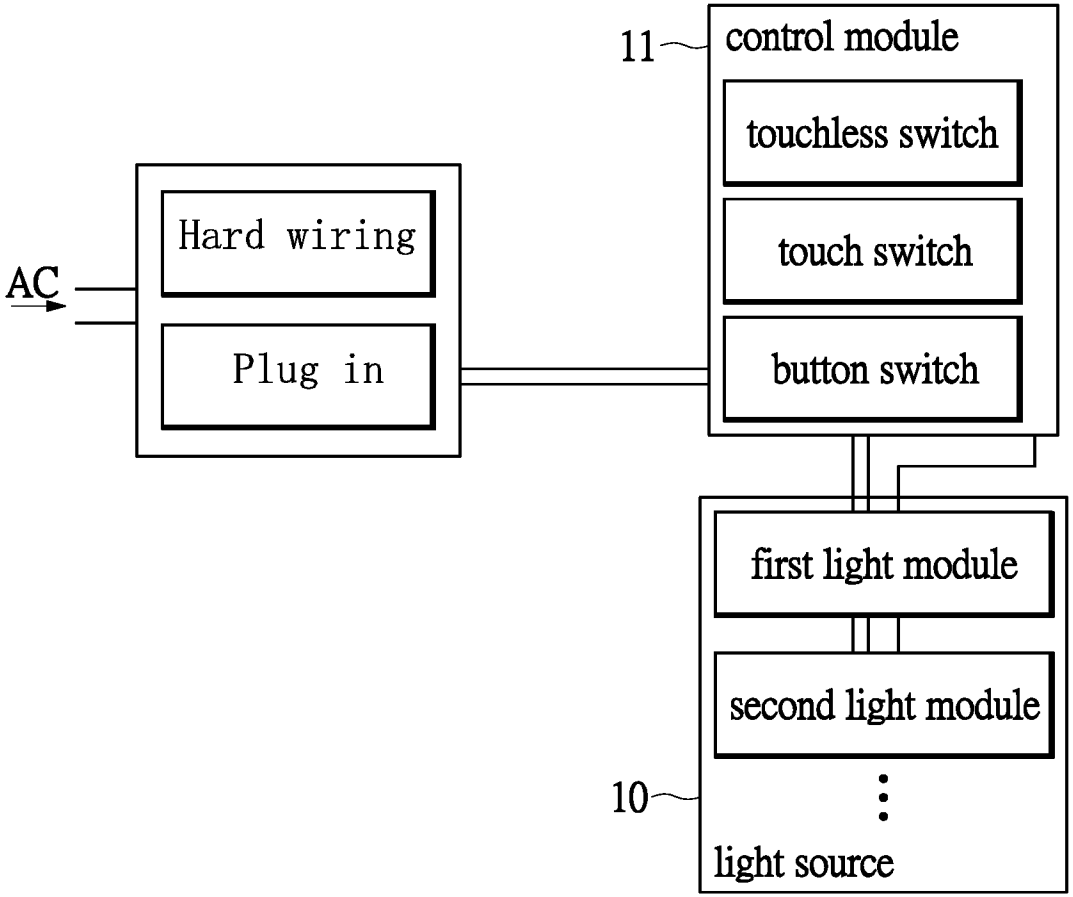
FIG. 2C show an architecture of an AC modularized light system according to an embodiment of the present disclosure.

Please refer to FIG. 2C showing a schematic diagram of an AC modularized light system. As high voltage LED light source for plug-in to AC power source has been widely adopted in the lighting industry, the manufacturing cost of high voltage LED has been substantially reduced. The use of high voltage LED to simplify or eliminate the driver for these purposes is matured. The AC modularized light system is adopted with this merit.

Figure 4:
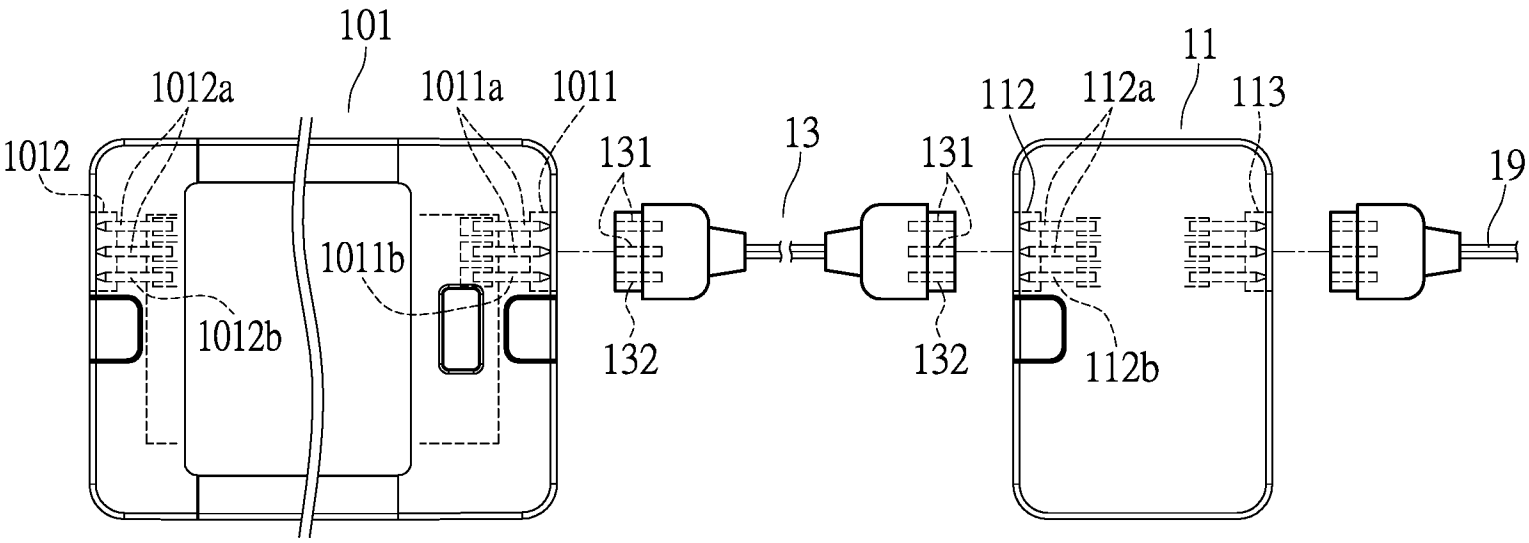
FIG. 4 shows a schematic diagram of a control module of a modularized light system connecting to a first light module according to an embodiment of the present disclosure.

Please refer to FIG. 3 in conjunction with FIG. 4, FIG. 4 shows a schematic diagram of a control module of a modularized light system connecting to a first light module according to an embodiment of the present disclosure. The most simplified architecture of the modularized light system includes the first light module 101, the control module 11, the power module 12 and the first connection unit 13 connected between the first light module 101 and the control module 11. Here, the condition of only the first light module 101 included in the light source is described firstly, then the added second light module 102, the third light module 103 . . . etc. would be further described in subsequent.

The first light module 101 has a first input portion 1011 and a first output portion 1012, and the first input portion has a first power terminal 1011*a* and a first control terminal 1011*b*. The first power terminal 1011*a* and the first control terminal 1011*b* are both electrical connectors. For example, the first power terminal 1011*a* is a male electrical plug or a female electrical outlet. It is worth mentioning that the first power terminal 1011*a* is for providing the direct current (DC) power loop, thus the first power terminal 1011*a* generally includes two connectors or two jacks. The first control terminal 1011*b* is adapted for transmitting the control signals, thus at least one connector or jack is needed accordingly.

The first output portion 1012 has a second power terminal 1012*a* and a second control terminal 1012*b*. The first output portion 1012 of the first light module 101 would only be used when the user needs to connect the second light module 102 after to the first light module 101 in series. When the first light module 101 is not connected to the second light module 102, the second power terminal 1012*a* and the second control terminal 1012*b* are opened without any function. The manner of the second light module 102 connecting to the first light module 101 would be further described in the subsequent embodiment shown in FIG. 5. In a simple way, the first light module 101 can be controlled by the control module through the first input portion 1011, and the first light module 101 can transmit the electrical power and the control signal from the control module 11 to the subsequent light modules.

The first light module 101 receives the control signal through the first control terminal 1011*b* of the first input portion 1011, and receives the DC power through the first power terminal 1011*a* of the first input portion 1011. The first light module 1011 emits light according to the control signal.

The control module 11 comprises a human machine interface (HMI) (which is not shown in FIG. 4 and would be described later referring to FIG. 6), an output portion 112 and an input portion 113. The output portion 112 has a power output terminal 112*a* and an output control terminal 112*b*. The human machine interface generates the control signal and outputs the control signal through the output control terminal 112*b*. The first connection unit 13 has a pair of first power wires 131 and at least a first control wire 132. The output portion 112 of the control module 11 detachably connects to the first input portion 1011 of the first light module 101 through the first connection unit 13, wherein the pair of power wires 131 is used for detachably connecting to the first power terminal 1011*a* of the first input portion 1011 and the power output terminal 112*a* of the output portion 112 The first control wire 132 is for detachably connecting to the first control terminal 1011*b* of the first input portion 1011 and the output control terminal 112*b* of the output portion 112. The first power terminal 1011*a* of the first input portion 1011 of the first light module 101 receives the DC power from the control module 11 through the pair of first power wires 131 of the first connection unit 13. The first control terminal 1011*b* of the first input portion 1011 of the first light module 101 receives the control signal from the control module 11 through the first control wire 132 of the first connection unit 13. The power module 12 has a power output portion (which is not shown in FIG. 4 and would be further described thereafter referring to FIG. 7), and the power output portion detachably connects to the input portion 113 of the control module 11 through the power line 19, for providing the DC power to the control module 11.

Figure 5:
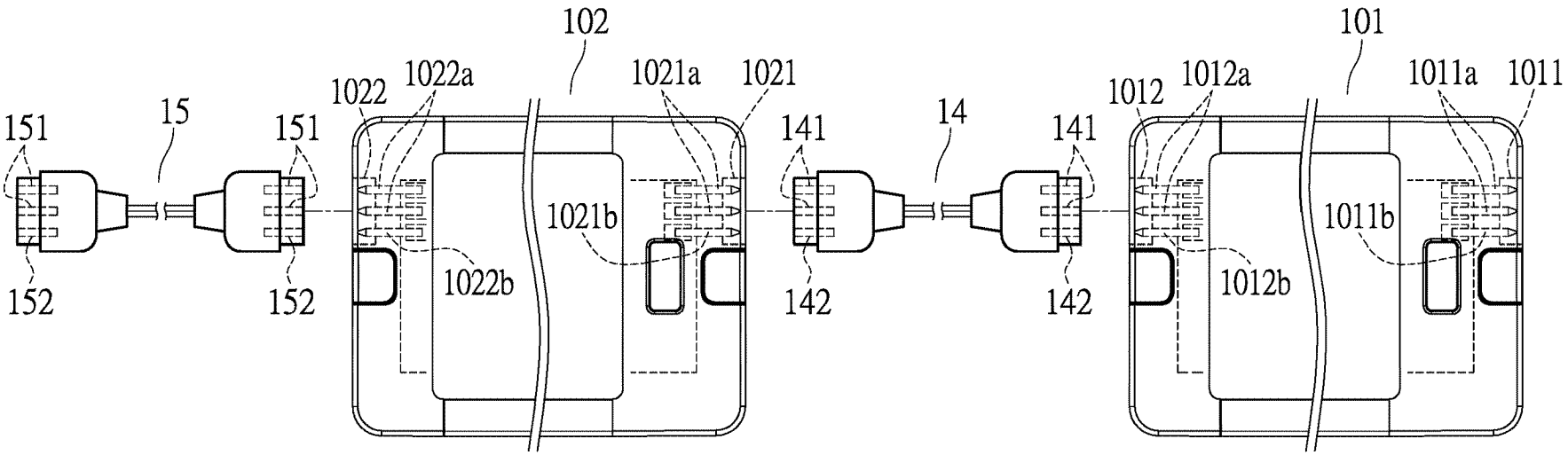
FIG. 5 shows a schematic diagram of a first light module of a modularized light system connecting to a second light module according to an embodiment of the present disclosure.

Please refer to FIG. 3 in conjunction with FIG. 5, FIG. 5 shows a schematic diagram of a first light module of a modularized light system connecting to a second light module according to an embodiment of the instant disclosure. The circuit topology of the first light module 101 is substantially identical to the circuit topology of the second light module 102; however the present disclosure does not restrict the appearance and the size of the first light module 101 and the second light module 102. That is, the appearance and the size of the first light module 101 and the second light module 102 may not the same, but the circuit topologies of the first light module 101 and the second light module 102 are the same, having the input portions and the output portions in the same specification, wherein the input portion receives the DC power and the control signal, the output portion is for outputting the DC power and the control signal received by the light module itself (through the input portion of itself) to other subsequent connected light module. Further, the same specification of input portions and the output portions are designed for the light modules, the control module and the power module to be in compliance with the connection unit such that to provide high flexibility of module connection. For instance, a direct connection of the power module to the first light module may enable a direct driving of the light module without through the control module. Furthermore, the control module can also be connected after a light module. Such a variation of module connection is in the scope of the modularized concept of the present disclosure. The control module is in fact an optional item which can be voided by using a wall switch to operate the on/off performance of the modularized light system. Alternatively the control module can be integrated with the power module or can be integrated with the light module to become a two-module light system.

Specifically, when the first light module 101 is further connected to the second light module 102, the connection manner is described as follows. The second light module 102 has a second input portion 1021 and a second output portion 1022. The second input portion 1021 has a third power terminal 1021*a* and a third control terminal 1021*b*. The second output portion 1022 has a fourth power terminal 1022*a* and a fourth control terminal 1022*b*. The second light module 102 receives the control signal through the third control terminal 1021*b* of the second input portion 1021 and receives the DC power through the third power terminal 1021*a* of the second input portion 1021. The second light module 102 emits light according to the control signal.

A second connection unit 14 has a pair of second power wires 141 and at least one second control wire 142. The first output portion 1012 of the first light module 101 detachably connects to the second input portion 1021 of the second light module 102 through the second connection unit 14, wherein the pair of the second power wires 141 is used for detachably connecting to the second power terminal 1012*a* of the first output portion 1012 and the third power terminal 1021*a* of the second input portion 1021. The second control wire 142 detachably connects to the second control terminal 1012*b* of the first output portion 1012 and the third control terminal 1021*b* of the second input portion 1021.

Please refer to FIG. 3 in conjunction with FIG. 5 again. When the second light module 102 is further connected to the third light module 103, the second light module 102 could utilize a third connection unit 15 for detachably connecting to the third light module 103. It is worth mentioning that the specifications of the connection terminals of the first connection unit 13, the second connection unit 14 and the third connection unit 15 are the same, however the lengths of the mentioned first connection unit 13, the second connection unit 14 and the third connection unit 15 may be different, thus the user could select the proper connection unit according requirement in practical applications, for connecting the needed number of the light modules, and the position of each light module would not be limited due to any specific length of the connection unit, the flexibility for arrangement with the use of space could be ensured accordingly.

For example, the third light module 103 has a third input portion (which is the same as the second input portion 1021) and a third output portion (which is the same as the second output portion 1022). The third input portion has a fifth power terminal (which is the same as the third power terminal 1021*a*) and a fifth control terminal (which is the same as the third control terminal 1021*b*). The third output portion has a sixth power terminal (which is the same as the fourth power terminal 1022*a*) and a sixth control terminal (which is the same as the fourth control terminal 1022*b*), wherein the third light module 103 receives the control signal through the fifth control terminal of the third input portion and receives the DC power through the fifth power terminal of the third input portion, and the third light module 103 emits light according to the control signal. The third connection unit 15 (as shown in FIG. 5) has a pair of third power wires 151 and a third control wire 152. The second output portion 1022 of the second light module 102 detachably connects to the third input terminal of the third light module 103 through the third connection unit 15, wherein the pair of third power wires 151 is for detachably connecting to the fourth power terminal 1022*a* of the second output portion 1022 and the fifth power terminal of the third input portion, and the third control wire 152 detachably connects to the fourth control terminal 1022*b* of the second output portion 1022 and the fifth control terminal of the third input portion.

Figure 6:
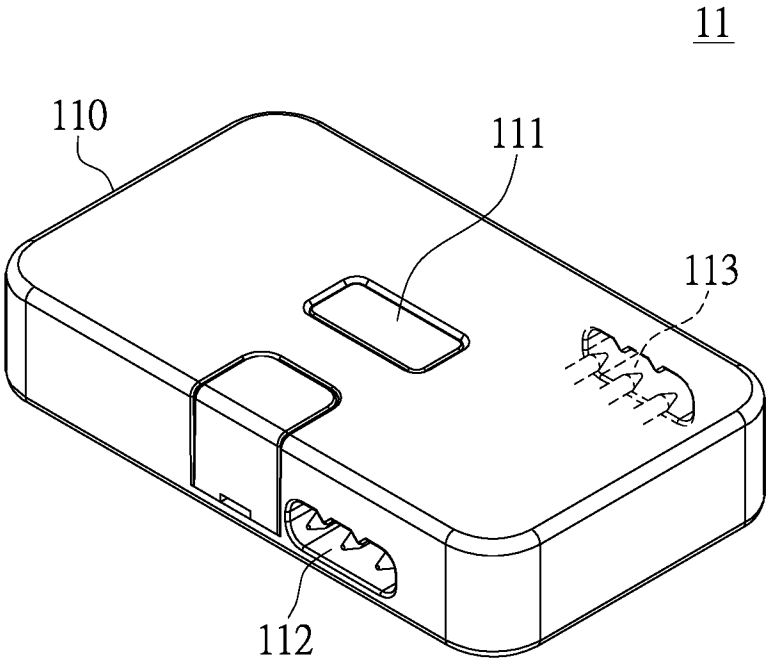
FIG. 6 shows a schematic diagram of a control module according to an embodiment of the present disclosure.

Please refer to FIG. 3 in conjunction with FIG. 6, FIG. 6 shows a schematic diagram of a control module according to an embodiment of the present disclosure. The control module 11 may comprise a body 110, a human machine interface 111, an output portion 112 and an input portion 113 disposed on the body 110. The appearance of the body is for ease of explanation, but not for restricting the scope of the instant disclosure. The human machine interface of the control module may be a touch control switch, a button switch or a touchless switch (such as an infrared sensing switch), but the present disclosure is not so restricted. The type of the human machine interface 111 may be changed according to the practical requirement. And, the position of the human machine interface 111 on the body 110 is also not so restricted. The input portion 113 receives the DC power from the power module 12. The output portion 112 may has three connectors for example, in which two connectors represent the power output terminal 112*a* and the left one is the output control terminal 112*b*. The power output terminal 112*a* provides the DC power to the connected light module, for example the first light module 101. The first light module 101 may further transmits the DC power to the connected second light module 102, the second light module 102 may further transmits the DC power to the connected third light module 103, and so on. The connections between each light module are achieved by utilizing the connection unit, and the length of the connection unit is not limited. It is worth mentioning that the control module 11 and the light modules are positioned detachably, thus the position of the light source 10 (including all light modules) may be different from the position of the human machine interface 111 of the control module 11, for example the human machine interface 111 may be far away from the light source 10 (including all light modules). Thus, the user may not stay close to the light source 10 (including all light modules) while manipulating the human machine interface 111. The control module 11 could be arranged close any position which is convenient to the user in manipulation, and the control module 11 does not need to be at the same position of the light source 10 (including all light modules), thereby the convenience of the usage of the light system is provided.

Furthermore, the control module 11 does not need to be right after a power module. It can be positioned anywhere among the light modules or at the end of the system. The multiple control modules with the same or different human machine interfaces may be connected in the system. These provide great convenience of manipulating the system performance.

Figure 7:
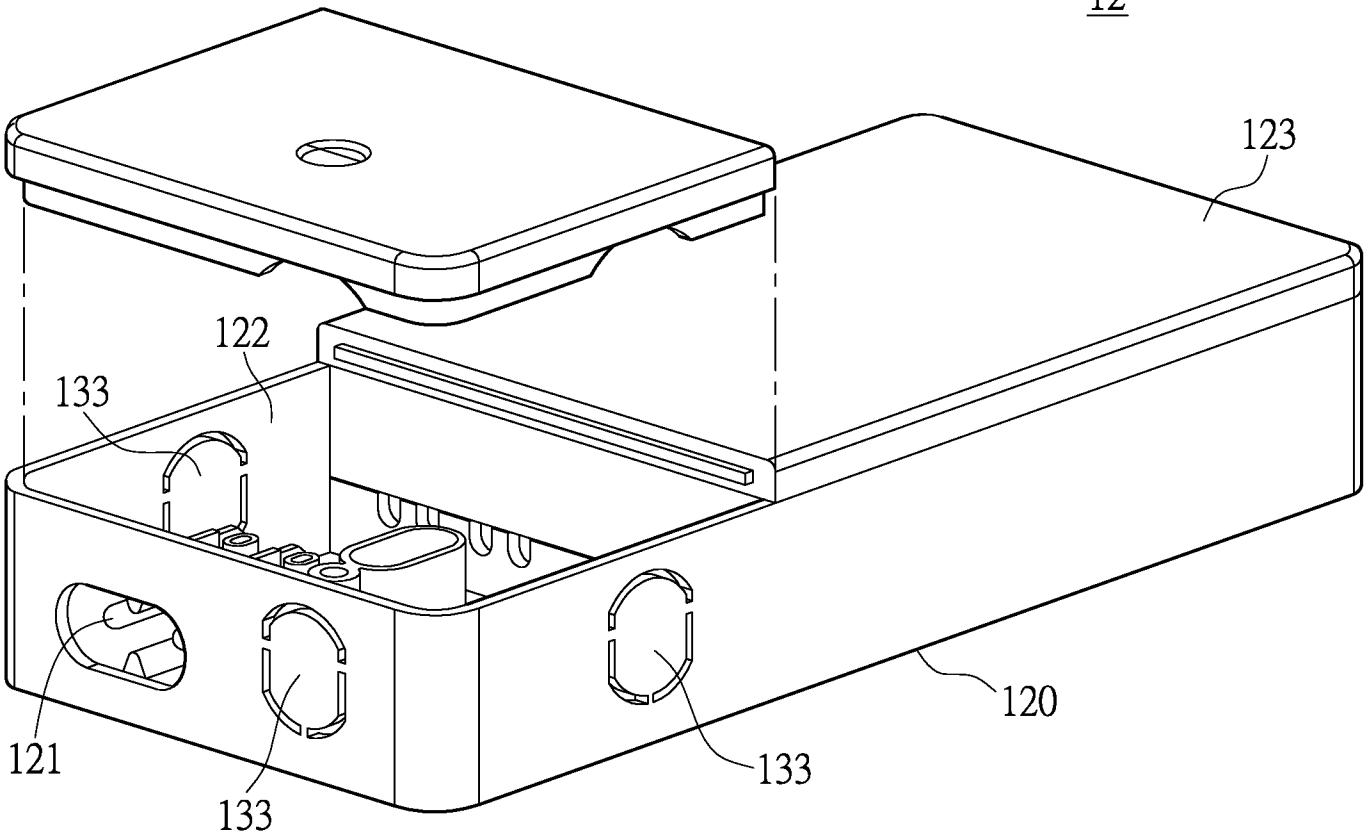
FIG. 7 shows a schematic diagram of a power module according to an embodiment of the present disclosure.

Please refer to FIG. 3 in conjunction with FIG. 4 and FIG. 7, FIG. 7 shows a schematic diagram of a power module according to an embodiment of the instant disclosure. The power module 12 comprise a body 120, an alternative current (AC) input portion 121, a battery containing portion 122, an AC/DC conversion unit 123 and three pre-punched holes 133 located in different facets of the body 120. The battery containing portion 122 could be disposed in the body 120, for installing at least one battery. The mentioned battery is for providing the direct current power, and the present disclosure does not restrict the type of the battery. The AC/DC conversion unit 123 converts the alternative current power to the direct current power. The power module 12 shown in FIG. 3 utilizes a power plug to receive the AC power. The AC/DC conversion unit 123 of the power module 12 in FIG. 7 receives the exterior AC power through the alternative current power input portion 121 of the body 120. In other words, the power module 12 may be designed as to provide the DC power by itself, such as utilizing the internal battery, or the power module 12 may convert the exterior high voltage AC power to the low voltage DC power for providing the needed DC power. The power module 12 provides a power output portion wherein the internal battery or the AC/DC conversion unit 123 utilizes the power line 19 (referring to FIG. 3 and FIG. 4) to detachably connect the input portion 113 of the control module 11 (shown in FIG. 4). It is worth mentioning that the appearance of the power module 12 is a thin box, which is especially adapted for installation of the cabinet light platform; thereby the whole light device could be inserted into a narrow flat space of the cabinet. However, the aforementioned embodiment is only for ease of explanation, the present disclosure is not so restricted. Referring to FIG. 7, the power module 12 of this embodiment connects to the AC power through the alternative current input portion 121 and transmits DC power to the control module 11 through the power output portion pertaining to the AC/DC conversion circuit 123, wherein this arrangement achieves the function of isolating high voltage AC power and low voltage DC power, so as to ensure the safety of the user. Basically, the power module 12 and the control module 11 can be designed to be separate, it only needs to use the power line 19 to connect the power module 12 and the control module 11, and the power line connected to the power module 12 and the control module 11 may be detachable, such that it is convenient for the user to change the relative positions of the power module 12 and the control module 11 base on needs, so as to increase the flexibility in the use of the light system. Besides the AC power input portion 121 of the body 120, the body 120 of the power module 12 is further designed with three pre-punched holes 133 (which are knock-out designed) located at different sides of the body, any of the pre-punched holes can be knocked to be opened for directly hard wiring the AC power lines with metal hose protection into the power module 12.

Figure 8:
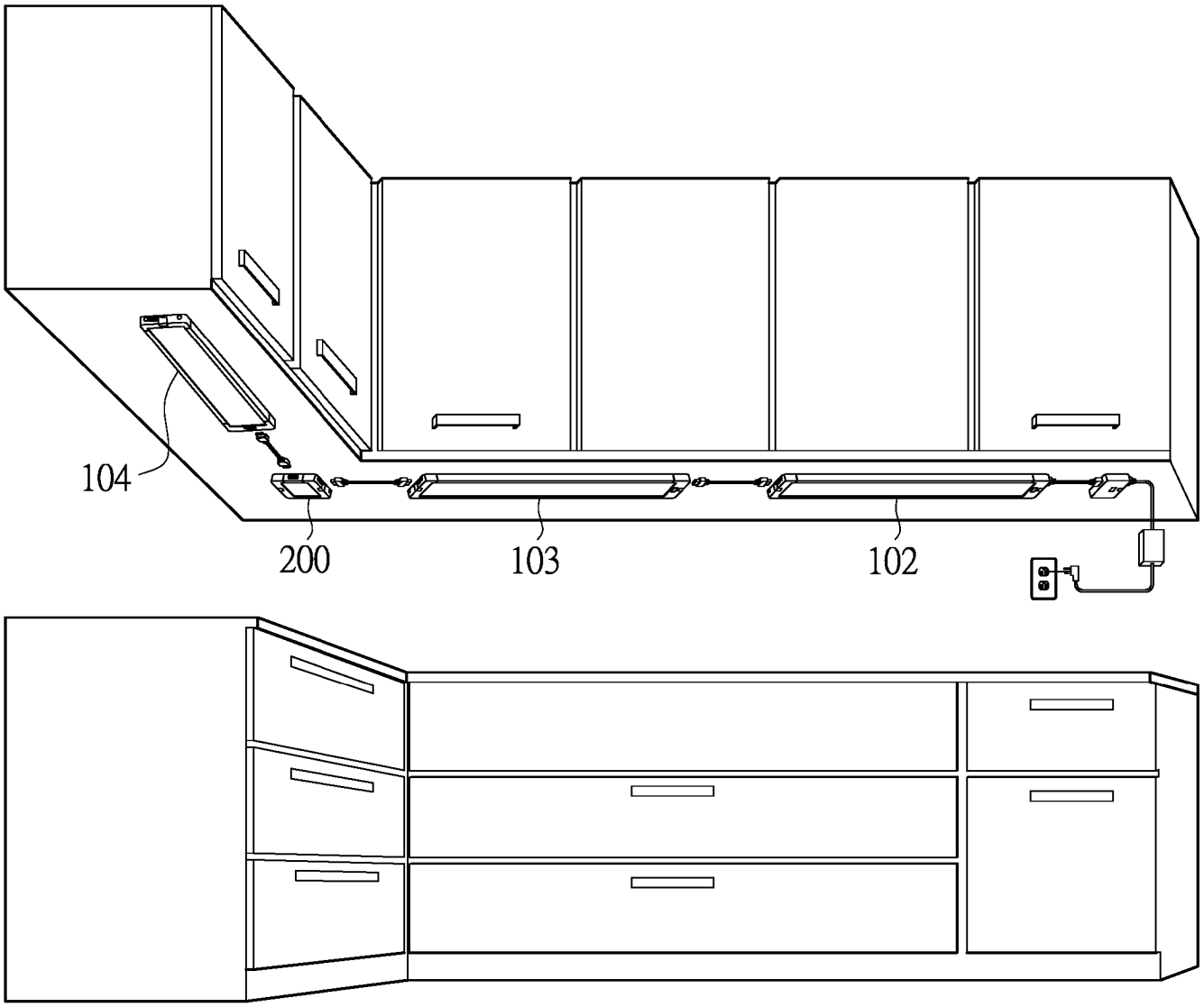
FIG. 8 shows a schematic diagram of a modularized of light system according to an embodiment of the present disclosure.
Figure 9:
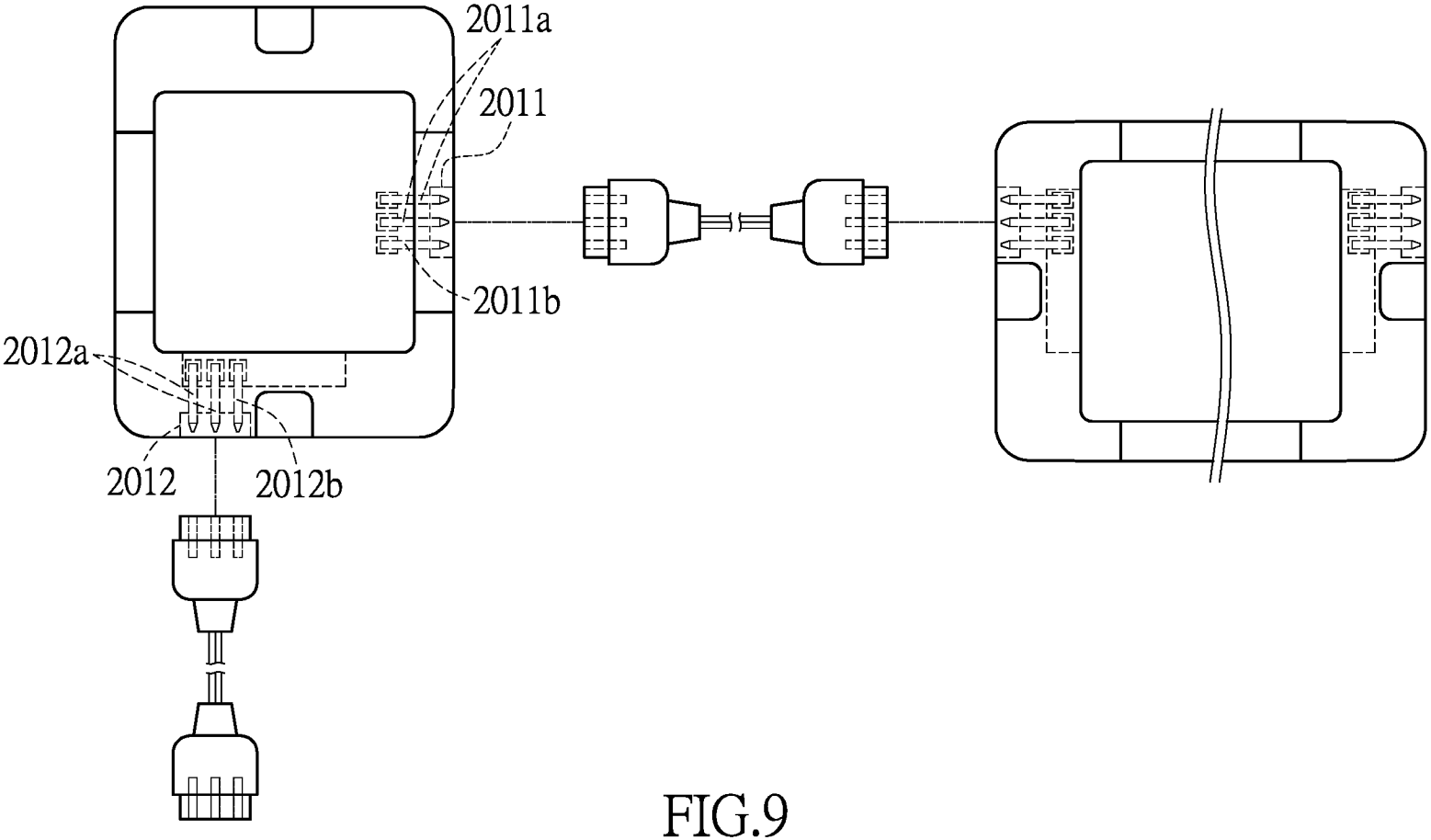
FIG. 9 shows a schematic diagram of a first light module connecting to a second light module with a right angle between its input and output orientations.
Figure 10A:
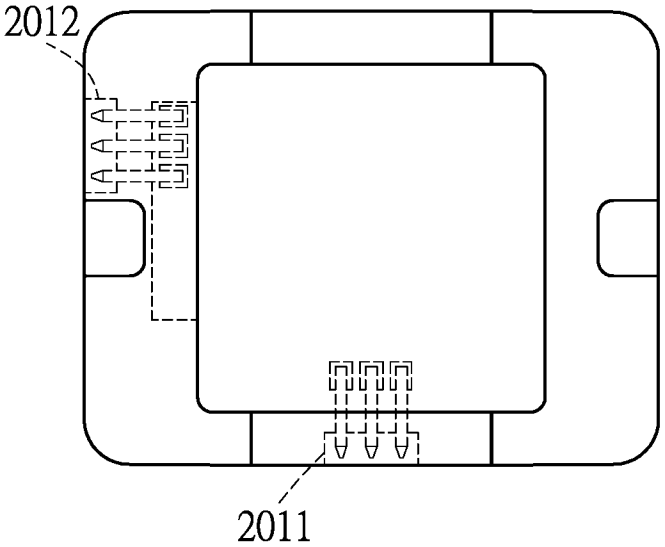
FIG. 10A shows a schematic diagram of a light module with a right angle between its input and output orientations.
Figure 10B:
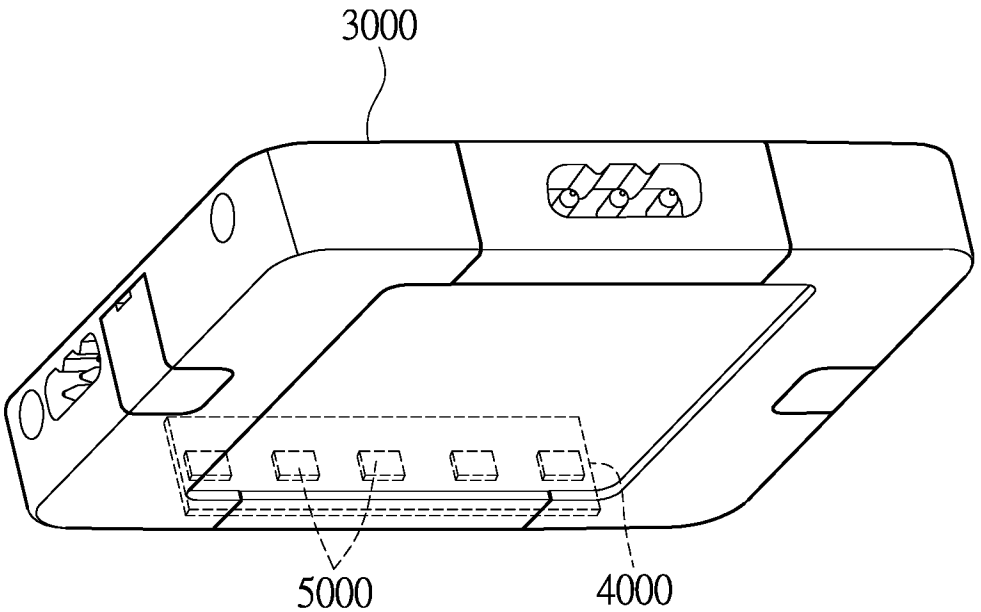
FIG. 10B shows a schematic diagram of the construction of a light module.
Figure 10C:
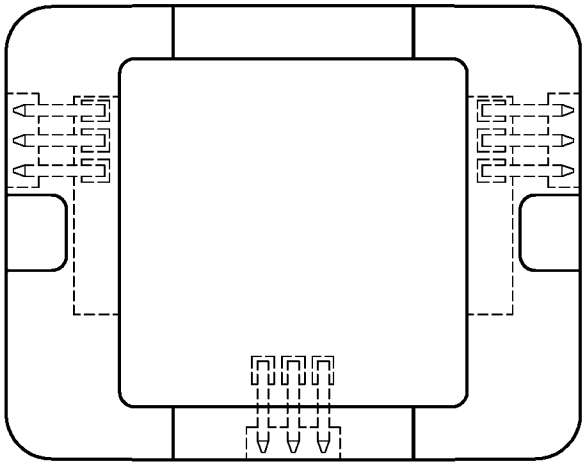
FIG. 10C shows a schematic diagram of a light module with more than two input and output connections.
Figure 10D:
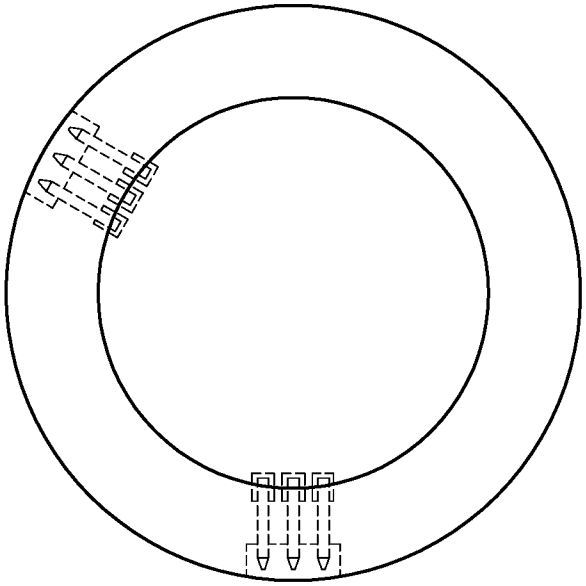
FIG. 10D shows a schematic diagram of a round shape light module with adjustable angle between its input and output orientations.

A cabinet system, particularly for kitchen cabinet, is often installed in a right angle corner in a kitchen area with two cabinet units integrated at the junction of two adjacent walls angled at 90 degrees. At the junction location where two cabinet units are integrated together a "L" shaped connector is often used to bridge the power transmission (signal transmission may also be needed for synchronization purpose) between the two adjacent under cabinet lights angled at 90 degrees with each other. In the absent of such "L" connector the connection between the two adjacent light modules often looks disordered. Furthermore, the junction location is often a dark area due to lack of an illumination unit suitable for installation at the junction location. Referring to FIG. 8 in conjunction with FIG. 9 and FIG. 10's, which schematically illustrates another embodiment of the present disclosure; wherein an under cabinet light system is installed with a kitchen cabinet system. The under cabinet light system includes three light modules 102, 103 and 104 linked together, the third light module 104 is installed with the left cabinet unit angled at 90 degrees against the other cabinet unit where the other two light modules are installed. As shown in FIG. 8, a linkable light module 200 is introduced at the junction location to bridge the light module 103 and the light module 104. The linkable light module 200 serves three functions: the first function is to be used as an organizer to make the connection at the junction look organized; the second function is to be used as a turning connector to bridge the power transmission from the third light module 103 to the fourth light module 104, wherein the two light modules are angled at 90 degrees against each other; the third function is to provide illumination to brighten the junction location. The linkable light module 200 is designed with one input portion 2011 and one output portion 2012 (see FIG. 9 and FIG. 10A), wherein the orientation of the input portion 2011 and the orientation of the output portion 2012 are angled at 90 degrees with each other; the input portion accordingly includes a power input terminal 2011*a* for receiving power supply and optionally may also include a control input terminal 2011*b* for managing synchronization, the output portion accordingly includes a power output terminal 2012*a* for delivering power to the next light module and may optionally include an output control terminal 2012*b* for delivering control signal (s) to the next connecting light module. Further refer to FIG. 10B and FIG. 10C, the linkable light module 200 is also composed of a body 3000, a light diffuser 4000 and a plurality of light-emitting diodes 5000 surface-mounted behind the light diffuser for performing illumination function. Also please refer to FIG. 10C, the linkable light module 200 comprises more than two input and output portions. Refer to FIG. 10D, the linkable module 200 is a round shape body, wherein the angle between input and output orientations is different from a 90 degrees angle.

According to above descriptions, a modularized light system and a control module and a power module thereof utilizes modularized connection manner to provide a plurality of combinations of light system, in order to meet the requirement of diverse lighting needs. Advantages of the embodiments are listed in the following: (1) A wire installation with more safety is provided. In security, a commercially available hardwire with higher voltage (such as 110V or 220V) is usually cooperated with a protection hose (applied for the European standards or American standard for example). In the modularized light system of the present disclosure, only the power module needs to connect with the hardwire, other modules such as the control module and the light module do not need to connect with the hardwire, thus applied voltage on the wiring of the control module, the light module and the connection units is lower voltage. Additionally, due to the lower voltage wires, the user does not need to worry about the leakage of electricity (in which the voltage of the leakage voltage is relative lower) when the user use the hand to touch (the switch) for manipulation. (2) A single power and a single control module are utilized to control one or more light modules, thus not all of the light modules (which may be the cabinet lights for example) have to connect with the corresponding power and control circuit in appearance. (3) The connections between the light modules are simple and can be adjusted as needed. (4) The light system could use the space efficiently, the number and the length of the wires can be reduced, thus the wire entanglement can be avoided while extending the system, and thereby the design and construction of the light system simplified. (5) The costs can be saved, and only one control module is needed even if multiple light modules are serially connected, for example: a multiple serially connected cabinet light shares the same control module. (6) The housing shapes for the three modules can be design coordinated to make the whole connected lighting system look elegantly organized in addition to the functional advantages.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A modularized LED lighting system, comprising:

at least one LED light module, wherein each of the at least one LED light module is configured with an input portion and an output portion, an LED lighting load and a control circuit, wherein the input portion having a power input terminal and a first control terminal, the output portion having a power output terminal and a second control terminal, wherein each of the at least one LED light module receives at least one control signal thru the first control terminal of the input portion or thru the second control terminal of the output portion and receives a DC power thru the power input terminal to emit light according to the at least one control signal received;

at least one control module, including a human-machine interface, an input control portion and an output control portion, the input control portion having at least a power input terminal and optionally a first control terminal, the output control portion having a power output terminal and a second control terminal, the human-machine interface of the control module generating the at least one control signal in response to an external control signal detected by the human-machine interface and outputting the control signal through the second control terminal of the output control portion or thru the first control terminal of the input control portion;

at least one connection unit, including a first connector, a second connector and a transmission cable connected between the first connector and the second connector to accommodate a pair of power wires and a control wire, for detachably connecting between the control module and the at least one LED light module, or between two adjacent LED light modules for transmitting the direct current (DC) power and the at least one control signal, wherein each of the at least one connection unit is configured with the same length or with different length as needed; and a power module, having at least a power output portion, detachably connecting to the input control portion of the control module or the input portion of the at least one LED light module for providing the DC power to the control module and the at least one LED light module.

2. The modularized LED lighting system according to claim 1, wherein at least one subsequent LED light module is further configured with a second human-machine interface for detecting a second external control signal and outputting a second control signal to control the lighting performance of the modularized LED lighting system, wherein the second control signal is able to override the first control signal in controlling the lighting performance of the modularized LED lighting system.

3. The modularized LED lighting system according to claim 2, wherein the second human-machine interface is a push button switch, a touch sensor switch or an active infrared ray sensor for detecting the second external control signal and accordingly outputting the second control signal.

4. The modularized LED lighting control system according to claim 2, wherein the second human-machine interface is configured to operate at least an on/off performance.

5. The modularized LED lighting system according to claim 2, wherein the second human-machine interface is configured to operate at least an on/off control and a dimming control.

6. The modularized LED lighting system according to claim 2, wherein the second human-machine interface is configured to operate at least a color temperature tuning control.

7. The modularized LED lighting system according to claim 1, wherein the control module is positioned at an end of the modularized LED light system through the connection unit.

8. The modularized LED lighting system according to claim 1, further comprising multiple LED light modules, wherein the control module is positioned and electrically coupled between two adjacent LED light modules of the multiple light modules through the connection units.

9. The modularized LED lighting system according to claim 1, further comprising more than one control modules and multiple LED light modules, wherein each of the multiple control modules is positioned and electrically coupled between either the power module and a first LED light module, or between any two adjacent LED light modules of the multiple modules thru the connection units.

10. The modularized LED lighting system according to claim 1, wherein the human-machine interface of the control module is a direct touch interface.

11. The modularized LED lighting system according to claim 10, wherein the direct touch interface includes at least one push button switch for controlling on/off performance and/or setting a light intensity of the modularized LED lighting system.

12. The modularized LED lighting system according to claim 10, wherein the direct touch interface includes at least one touch pad switch for controlling on/off performance and/or setting a light intensity of the modularized LED lighting system.

13. The modularized LED lighting system according to claim 10, wherein the direct touch interface is a slide switch including at least two grounding points for selecting an on/off performance or a light intensity performance of the modularized LED lighting system.

14. The modularized LED lighting system according to claim 1, wherein the human-machine interface is a touch less interface.

15. The modularized LED lighting system according to claim 14, wherein the touch less interface is an active infrared ray sensor for detecting and interpreting a human motion signal in a detection zone for controlling an on/off performance and/or setting a light intensity of the modularized LED lighting system.

16. The modularized LED lighting system according to claim 14, wherein the touch less interface is a passive infrared ray sensor for detecting a motion event for controlling an on/off lighting performance of the modularized LED lighting system.

17. The modularized LED lighting system according to claim 14, wherein the touch less interface is a wireless signal receiver to receive a wireless external control signal for controlling an on/off performance and/or setting a light intensity of the modularized LED lighting system.

18. The modularized light system according to claim 1, wherein the power module further comprises:

a body; and a battery containing portion, disposed in the body, being used for installing at least a battery, the battery being used for providing the direct current power.

19. The modularized LED lighting system according to claim 1, wherein the power module further includes:

an AC/DC power conversion unit, converting an alternative current power to the direct current power.

20. The modularized LED lighting system according to claim 19, wherein the body is further configured with at least one pre-punched hole on at least one side to be knocked out for hard wiring an AC power source to connect to the AC/DC power conversion unit.

21. The modularized LED lighting system according to claim 19, wherein the body is further configured with an AC power cord with a plug to connect to an electrical outlet.

22. The modularized lighting system according to claim 1, wherein a first LED light module further includes an AC/DC conversion unit which converts an alternative current power to a direct current power; wherein the power module is an AC wiring connected to the input portion of the first LED light module.

23. A modularized LED lighting system, comprising:

a plurality of LED light modules with each LED light module being configured with at least an input portion, an output portion and a human-machine interface, an LED lighting load and a control circuit; wherein the input portion is configured with a power input terminal and a first control terminal, wherein the output portion is configured with a power output terminal and a second control terminal, wherein the human-machine interface generates at least one control signal to deliver to the control circuit in response to an external control signal detected by the human-machine interface; wherein each LED light module receives a direct current (DC) power from the power input terminal and receives the at least one control signal from the human-machine interface or from the first control terminal of the input portion or from the second control terminal of the output portion, wherein each of the at least one light module emits light according to the at least one control signal received by one of the plurality of LED light modules;

at least one connection unit, including a first connector, a second connector and a transmission cable connected between the first connector and the second connector to accommodate a pair of power wires and a control wire, for detachably connecting between two adjacent LED light modules for transmitting the direct current (DC) power and the at least one control signal; and a power module, having a power output portion, detachably connecting to the input portion of a first LED light module of the plurality of light emitting modules thru a connection unit for providing the DC power to the modularized LED lighting system.

* * * * *